US005629466A

United States Patent [19]

Randolph

[11] Patent Number: 5,629,466

[45] Date of Patent: May 13, 1997

[54] METHOD FOR REMOVING AMYLENES FROM GASOLINE AND ALKYLATING SUCH AMYLENE AND OTHER OLEFINS WHILE MINIMIZING SYNTHETIC ISOPENTANE PRODUCTION

[75] Inventor: Bruce B. Randolph, Bartlesville, Okla.

[73] Assignee: Phillips Petroleum Company, Bartlesville, Okla.

[21] Appl. No.: 409,226

[22] Filed: Mar. 23, 1995

[51] Int. Cl.[6] ..... C07C 2/58

[52] U.S. Cl. ..... 585/724

[58] Field of Search ..... 585/724

[56] References Cited

U.S. PATENT DOCUMENTS 3,795,712 3/1974 Torck et al. ..... 260/671 C 5,382,744 1/1995 Abbott et al. ..... 585/709

*Primary Examiner*—Helane Myers

*Assistant Examiner*—In Suk Bullock

*Attorney, Agent, or Firm*—Charles W. Stewart

[57] ABSTRACT

A method for removing from a gasoline pool and alkylating amylenes in the presence of a hydrogen fluoride catalyst while suppressing or inhibiting the production of synthetic isopentane during the alkylation of such amylenes by the addition of sulfone to the hydrogen fluoride catalyst.

19 Claims, 1 Drawing Sheet

Figure 1:
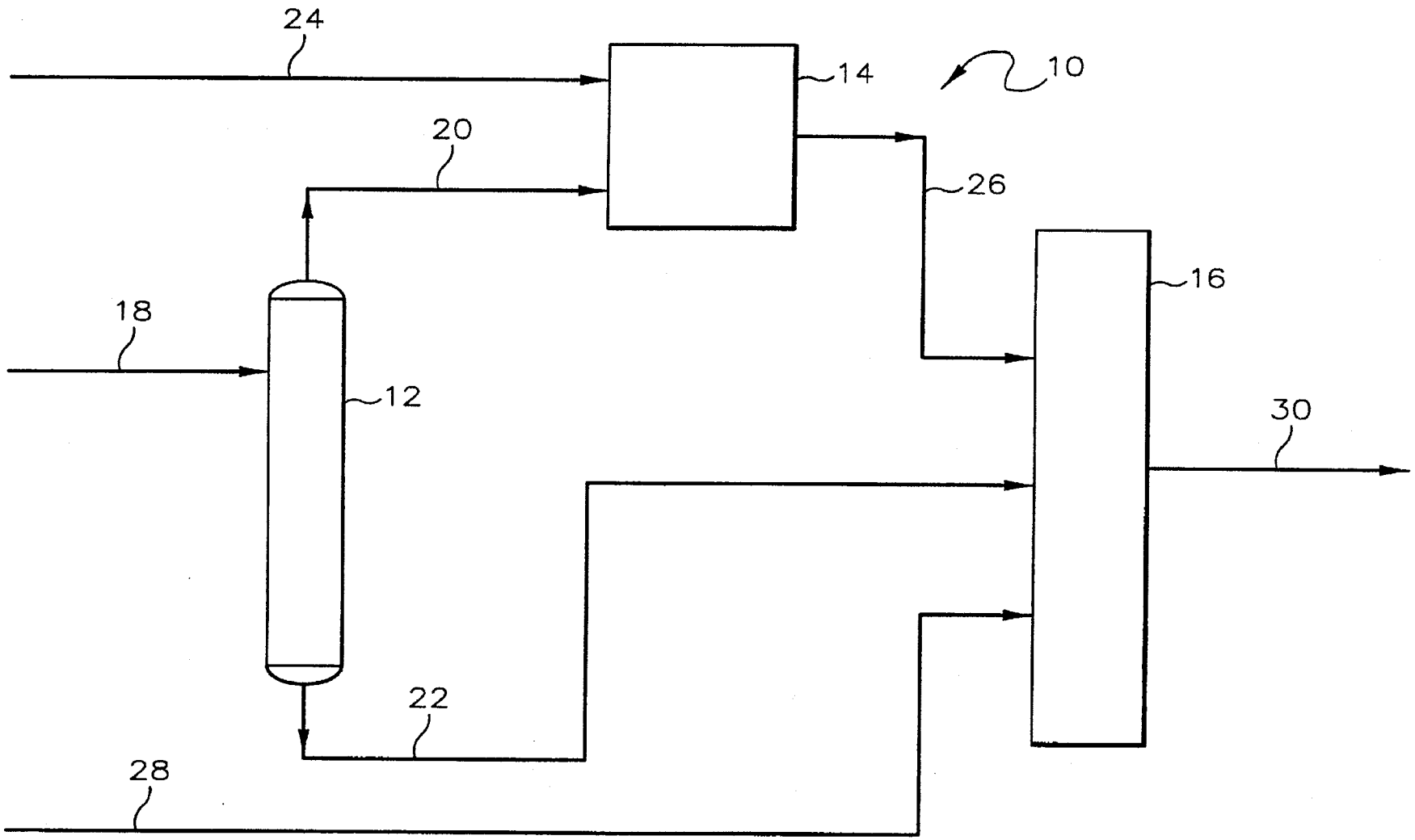

METHOD FOR REMOVING AMYLENES FROM GASOLINE AND ALKYLATING SUCH AMYLENE AND OTHER OLEFINS WHILE MINIMIZING SYNTHETIC ISOPENTANE PRODUCTION

This invention relates to the alkylation of olefins. More specifically, the invention relates to the alkylation of amylenes and other olefins with the suppression of the production of synthetic isopentane during such alkylation.

Government regulations are increasingly requiring the removal of olefin compounds from gasoline and the limiting of gasoline vapor pressure. Efforts to remove amylene olefin compounds from a gasoline pool, however, pose numerous problems. One particular problem relates to finding some other use of the amylenes removed from the gasoline pool. One use for such amylenes can be as an alkylation reaction feed material. This use, however, itself creates problems. For example, an amylene alkylate can be an inferior alkylate to other forms of alkylate, particularly, a butylene alkylate, and it can have a lower octane value than some amylene olefins. Also, synthetic isopentane is formed during the alkylation of amylene olefin compounds as well as during the alkylation of propylene and butylene. Traditionally, the production of synthetic isopentane has not been much of a concern; but, instead, it has been desirable because of the relatively high octane value of isopentane. However, due to the aforementioned regulatory changes, which require a lower gasoline vapor pressure than previously allowed, it is undesirable to increase the amount of isopentane in the gasoline pool. The formation of synthetic isopentane during the catalytic alkylation of amylene offsets some of the benefits that result from the alkylation of amylene removed from the gasoline pool by increasing the vapor pressure thereof. It is also desirable to reduce the amount of synthetic isopentane produced during the alkylation of propylene and butylene.

It is thus an object of this invention to provide a method for removing olefins, particularly amylenes, from a gasoline pool.

A further object of this invention is to convert amylenes removed from a gasoline pool into a suitably high octane gasoline component.

A still further object of this invention is to provide an amylene alkylate, produced by the alkylation of amylene with an isoparaffin, with a reduced production of synthetic isopentane.

A yet further object of this invention is to reduce the amount of synthetic isopentane produced during the alkylation of propylene, butylene and amylene.

The invention is an improvement in a method for producing gasoline by reducing the amount of amylene that is contained in a gasoline pool while minimizing the production of synthetic isopentane. A cracked hydrocarbon stream is passed to a fractionator which splits the cracked hydrocarbon stream into a bottoms stream, containing hydrocarbons having at least five carbon atoms, and an overhead stream, containing hydrocarbons having less than five carbon atoms. The overhead stream is passed to an alkylation process system for alkylating olefins with isoparaffins in the presence of a hydrogen fluoride alkylation catalyst to produce an alkylate product. The alkylate product and bottoms stream are passed to a gasoline pool. To remove the amylene olefins from the gasoline pool, the amount of amylenes in the bottoms stream is reduced by shielding amylenes into the overhead stream. The synthetic isopentane production resulting from the conventional hydrogen fluoride catalyzed alkylation of amylene is suppressed by the addition of sulfone to the hydrogen fluoride alkylation catalyst of the alkylation process system.

Another embodiment of the invention includes a method for controlling the amount of synthetic isopentane produced during the catalytic alkylation of olefins selected from the group consisting of propylene, butene, amylenes and mixtures of two or more thereof by utilizing an alkylation catalyst containing hydrogen fluoride and sulfolane in an alkylation process to produce an alkylate product containing a desired amount of synthetic isopentane produced by the catalytic alkylation of olefins. This method includes specifying the desired amount of synthetic isopentane produced by the catalytic alkylation of olefins and measuring the actual amount of synthetic isopentane produced. A difference between the desired amount of synthetic isopentane production and the measured amount is determined which provides a differential value for determining how to adjust the ratio of the hydrogen fluoride-to-sulfone in the alkylation catalyst so that the difference can be narrowed and to provide a synthetic isopentane production that approaches the desired synthetic isopentane production.

In the accompanying drawing:

FIG. 1 is a schematic representation of the overall process system related to the inventive method.

Other objects and advantages of the invention will be apparent from the following detailed description of the invention and the appended claims thereof.

The inventive method is one which provides for the production of gasoline in a manner so as to reduce the mount of amylene contained in a gasoline pool by alkylating amylenes removed therefrom. The conventional alkylation of amylene using a hydrogen fluoride catalyst, however, generally results in a significant production of undesirable synthetic isopentane. The inventive method suppresses the production of synthetic isopentane during the alkylation of amylenes and other olefins such as propylene and butylene through the addition of sulfone to the hydrogen fluoride alkylation catalyst in an amount effective for suppressing the synthetic isopentane production below such production when no sulfone is added to the hydrogen fluoride alkylation catalyst. Thus, the amount of sulfone added to the hydrogen fluoride alkylation catalyst will be such as to provide a weight ratio of hydrogen fluoride to sulfone in the range of from about 1:1 to about 40:1. Preferably, the weight ratio of hydrogen fluoride to sulfone can be in the range of from about 2.0:1 to about 8.5:1 and, more preferably, the weight ratio shall range from 2.3:1 to 4:1.

As used herein, the term "synthetic isopentane" shall mean the net isopentane produced during a hydrogen fluoride catalyzed alkylation reaction of olefin compounds with isoparaffin compounds. Thus, the synthetic isopentane produced during an alkylation reaction shall be the difference between the total mass of isopentane contained in an alkylate product effluent leaving an alkylation reaction zone and the total mass of isopentane contained in the feedstock to the alkylation reaction zone.

It is theorized that one reaction mechanism by which synthetic isopentane is produced is the result of a hydrogen transfer reaction which is a chain initiated reaction in which tertiary butyl carbonium ions are formed and are involved in the chain reaction to form the ultimate products of isopentane and a paraffin hydrocarbon. One theorized mechanism for the hydrogen transfer reaction which occurs when amylene is alkylated with isobutane is as follows. See, Rosenwald, R. H. *Kirk-Othmer Encyclopedia of Chemical Technology,* 3rd Ed. (1978), 2, 50.

$$C_5H_{10} + H^+ \longrightarrow C_5H_{11}^+$$

$$C_5H_{11}^+ + iC_4H_{10} \longrightarrow C_5H_{12} + iC_4H_9^+$$

$$iC_4H_9^+ \longrightarrow iC_4H_8 + H^+$$

$$iC_4H_8 + iC_4H_9^+ \longrightarrow iC_8H_{17}$$

$$iC_8H_{17}^+ + iC_4H_{10} \longrightarrow iC_8H_{18} + i\,C_4H_9^+$$

$$\text{NET: } C_5H_{10} + 2iC_4H_{10} \longrightarrow C_5H_{12} + iC_8H_{18}$$

Another possible reaction mechanism by which synthetic isopentane is produced is through the cracking or scission of larger carbocations. The carbocations are formed by the reaction of olefin compounds with other olefin compounds to give higher molecular weight cations which can fragment to give synthetic isopentane. This is one mechanism believed to be the cause of the production of synthetic isopentane from olefins having a molecular weight that is less than that for amylene. Such olefins include propylene and butylenes.

The inventive process provides for the removal of amylenes from a gasoline pool and the subsequent catalyzed alkylation of the amylenes with an isoparaffin to produce an amylene alkylate. By utilizing the novel features of the inventive process, the amount of synthetic isopentane produced during the alkylation of the amylenes removed from the gasoline pool is suppressed below that which would normally be produced by conventional alkylation methods which use conventional alkylation catalysts such as hydrogen fluoride and sulfuric acid, particularly, hydrogen fluoride.

In a typical fluidized catalytic cracker (FCC) operation, there is provided a fractionator, often referred to as an FCC debutanizer, utilized for fractionating an FCC cracked hydrocarbon stream into a bottoms stream, known as an FCC gasoline stream and generally containing hydrocarbons having at least five (5) carbon atoms, and an overhead stream, generally containing hydrocarbons having less than five (5) carbon atoms. The FCC debutanizer bottoms stream can contain $C_5$ olefin hydrocarbons, or amylenes (pentenes). In the conventional operation of an FCC debutanizer, the bottoms stream can contain amylenes upwardly to about 20 mol percent, and typically, they can range from about 5 mol percent to about 15 mol percent. A more common concentration range of amylenes in the FCC debutanizer bottoms stream is from 5 mol percent to 15 mol percent.

The FCC debutanizer overhead stream generally contains hydrocarbons having four carbon atoms ($C_4$ hydrocarbons). Typically, the FCC debutanizer overhead stream can contain upwardly to about 70 or 80 mol percent $C_4$ hydrocarbons. Of the $C_4$ hydrocarbons, from 5 to 95 percent are olefins, or propylene and butylenes. Thus, in the conventional operation of an FCC debutanizer, the overhead stream can contain butylenes upwardly to about 75 mol percent, and typically, they can range from about 1 mol percent to about 70 mol percent. A more common concentration range of butylenes in the FCC debutanizer overhead stream is from 5 mol percent to 60 mol percent. Also, during typical operation, the FCC debutanizer overhead stream will have a minimal concentration of amylenes perhaps ranging upwardly to about 2 to 5 mol percent.

In the novel method of producing gasoline, the FCC cracked hydrocarbon stream is passed to the FCC debutanizer, or fractionator, which is operated so as to reduce the amount of amylenes contained in the bottoms stream by shifting the reduced amount of amylenes into the overhead stream. To achieve this, the operation of the FCC debutanizer can be altered in one or more ways to provide for a shift in an amount of amylenes in the bottoms stream into the overhead stream thus operating the FCC debutanizer much like a depentanizer. Included among these changes in operation is an increase in the overhead draw rate, a decrease in fractionator reflux, a reduction in fractionator pressure or any combination thereof.

When the FCC debutanizer is operated in the mode by which the amount of amylene contained in the bottoms stream is minimized through shifting amylenes into the overhead stream, the concentration of amylenes in the overhead stream can be in the range of from about 5 mol percent to about 40 mol percent. Preferably, the overhead stream can contain amylenes in the concentration range of from about 7.5 mol percent to about 35 mol percent and, most preferably, the concentration of amylenes can range from 15 mol percent to 30 mol percent.

By shifting a portion of the amylenes from the fractionator bottoms stream to the overhead stream, the concentration of amylenes contained in the bottoms stream is thereby reduced generally to the range of from less than 1 mol percent upwardly to about 5 mol percent. Thus, the concentration of amylenes in the bottoms stream will normally be in the range of from about 1 mol percent to about 5 mol percent and, preferably, from about 2 mol percent to about 4 mol percent. Most preferably, the amylene concentration of the fractionator bottoms stream when the fractionator is operated in the mode for shifting amylenes to the fractionator overhead stream can be from 2 mol percent to 4 mol percent.

In a typical processing scheme, the FCC debutanizer overhead stream is passed to an alkylation process system for alkylating olefins with isoparaffins in the presence of a hydrogen fluoride alkylation catalyst to form an alkylate product. The alkylate product and the bottoms stream from the FCC debutanizer are both passed to a gasoline pool ultimately for blending and introduction into the marketplace.

One disadvantage to the removal of amylenes from the gasoline pool of a process system and passing the thus-removed amylenes to an HF alkylation process system for alkylation is the undesirable production of synthetic isopentane which accompanies the alkylation of amylenes. An important aspect of the inventive process is its ability to remove amylenes from a gasoline pool and to alkylate the amylenes with a minimum production of synthetic isopentane.

The inventive process suppresses or inhibits the production of synthetic isopentane from propylene, butylenes, and amylenes by the use of a sulfone additive to a hydrogen fluoride alkylation catalyst. The sulfone is added to the hydrogen fluoride alkylation catalyst of the alkylation process system in an amount such that synthetic isopentane production is suppressed or inhibited below such production when no sulfone is added to the hydrogen fluoride alkylation catalyst. Thus, a synthetic isopentane production suppressing amount of sulfone is added to the hydrogen fluoride alkylation catalyst to thereby reduce the mount of synthetic isopentane produced during the alkylation of amylenes as well as propylene and butylenes.

In the conventional hydrogen fluoride catalyzed alkylation of amylenes, the weight ratio of synthetic isopentane produced per amylene charged to the alkylation reaction zone of an alkylation process system exceeds 0.6:1. Particularly, the weight ratio of synthetic isopentane produced per amylene charge exceeds 0.7:1 and, most particularly, it can exceed 0.8:1. As for the inventive method, the addition of a synthetic isopentane production suppressing amount of sulfone to an HF alkylation catalyst can suppress the synthetic isopentane production such that the weight ratio of synthetic isopentane produced per amylene charge is less than about 0.6:1. Preferably, this weight ratio is less than about 0.5:1 and, most preferably, it is less than 0.4:1.

The sulfones suitable for use in this invention are the sulfones of the general formula $$R—SO_2—R^1$$

wherein R and R' are monovalent hydrocarbon alkyl or aryl substituents, each containing from 1 to 8 carbon atoms. Examples of such substituents include dimethylsulfone, di n-propylsulfone, diphenylsulfone, ethylmethyl- sulfone, and the alicyclic sulfones wherein the $SO_2$ group is bonded to a hydrocarbon ring. In such a case, R and R' are forming together a branched or unbranched hydrocarbon divalent moiety preferably containing from 3 to 12 carbon atoms. Among the latter, tetramethylenesulfone or sulfolane, 3-methylsulfolane and 2,4-dimethylsulfolane are more particularly suitable since they offer the advantage of being liquid at process operating conditions of concern herein. These sulfones may also have substituents, particularly one or more halogen atoms, such as for example, chloromethylethylsulfone. These sulfones may advantageously be used in the form of mixtures.

Alkylation processes contemplated by the present invention are those liquid phase processes wherein mono-olefin hydrocarbons such as propylene, butylenes, pentylenes, hexylenes, heptylenes, octylenes and the like are alkylated by isoparaffin hydrocarbons such as isobutane, isopentane, isohexane, isoheptane, isooctane and the like for production of high octane alkylate hydrocarbons boiling in the gasoline range and which are suitable for use in gasoline motor fuel. Preferably, isobutane is selected as the isoparaffin reactant and the olefin reactant is selected from propylene, butylenes, pentylenes and mixtures thereof for production of an alkylate hydrocarbon product comprising a major portion of highly branched, high octane value aliphatic hydrocarbons having at least seven carbon atoms and less than ten carbon atoms.

In order to improve selectivity of the alkylation reaction toward the production of the desirable highly branched aliphatic hydrocarbons having seven or more carbon atoms, a substantial stoichiometric excess ofisoparaffin hydrocarbon is desirable in the reaction zone. Molar ratios of isoparaffin hydrocarbon to olefin hydrocarbon of from about 2:1 to about 25:1 are contemplated in the present invention. Preferably, the molar ratio of isoparaffin-to-olefin will range from about 5 to about 20; and, most preferably, it shall range from 8.5 to 15. It is emphasized, however, that the above recited ranges for the molar ratio of isoparaffin-to-olefin are those which have been found to be commercially practical operating ranges; but, generally, the greater the isoparaffin-to-olefin ratio in an alkylation reaction, the better the resultant alkylate quality.

Isoparaffin and olefin reactant hydrocarbons normally employed in commercial alkylation processes are derived from refinery process streams and usually contain small amounts of impurities such as normal butane, propane, ethane and the like. Such impurities are undesirable in large concentrations as they dilute reactants in the reaction zone, thus decreasing reactor capacity available for the desired reactants and interfering with good contact of isoparaffin with olefin reactants. Additionally, in continuous alkylation processes wherein excess isoparaffin hydrocarbon is recovered from an alkylation reaction effluent and recycled for contact with additional olefin hydrocarbon, such nonreactive normal paraffin impurities tend to accumulate in the alkylation system. Consequently, process charge streams and/or recycle streams which contain substantial amounts of normal paraffin impurities are usually fractionated to remove such impurities and maintain their concentration at a low level, preferably less than about 5 volume percent, in the alkylation process.

Alkylation reaction temperatures within the contemplation of the present invention are generally in the range of from about 0° F. to about 150° F. Lower temperatures favor alkylation reaction ofisoparaffin with olefin over competing olefin side reactions such as polymerization. However, overall reaction rates decrease with decreasing temperatures. Temperatures within the given range, and preferably in the range from about 30° F. to about 130° F., provide good selectivity for alkylation of isoparaffin with olefin at commercially attractive reaction rates. Most preferably, however, the alkylation temperature should range from 50° F. to 100° F.

Reaction pressures contemplated in the present invention may range from pressures sufficient to maintain reactants in the liquid phase to about fifteen (15) atmospheres of pressure. Reactant hydrocarbons may be normally gaseous at alkylation reaction temperatures, thus reaction pressures in the range of from about 40 pounds gauge pressure per square inch (psig) to about 160 psig are preferred. With all reactants in the liquid phase, increased pressure has no significant effect upon the alkylation reaction.

Contact times for hydrocarbon reactants in an alkylation reaction zone in the presence of the alkylation catalyst of the present invention should generally be sufficient to provide essentially complete conversion of olefin reactant in the alkylation zone. Preferably, the contact time is in the range from about 0.05 minute to about 60 minutes. In the alkylation process of the present invention, employing isoparaffin-to-olefin molar ratios in the range of about 2:1 to about 25:1, wherein the alkylation reaction mixture comprises about 40–90 volume percent catalyst phase and about 60–10 volume percent hydrocarbon phase, and wherein good contact of olefin with isoparaffin is maintained in the reaction zone, essentially complete conversion of olefin can be obtained at olefin space velocities in the range of about 0.1 to about 200 volumes olefin per hour per volume catalyst (v/v/hr.). Optimum space velocities will depend upon the type of isoparaffin and olefin reactants utilized, the particular compositions of alkylation catalyst, and the alkylation reaction conditions. Consequently, the preferred contact times are sufficient for providing an olefin space velocity in the range of about 0.1 to about 200 (v/v/hr.) and allowing essentially complete conversion of olefin reactant in the alkylation zone.

The process may be carried out either as a batch or continuous type of operation, although it is preferred for economic reasons to carry out the process continuously. It has been generally established that in alkylation processes, the more intimate the contact between the feedstock and the catalyst the better the quality of alkylate product obtained. With this in mind, the present process, when operated as a batch operation, mixes reactants and catalyst by the use of vigorous mechanical stirring or shaking or by the use of jet nozzles, thimbles and the like.

In continuous operations, in one embodiment, reactants may be maintained at sufficient pressures and temperatures to maintain them substantially in the liquid phase and then continuously forced through dispersion devices into the reaction zone. The dispersion devices can be jets, nozzles, porous thimbles and the like. The reactants are subsequently mixed with the catalyst by conventional mixing means such as mechanical agitators or turbulence of the flow system. After a sufficient time, the product can then be continuously separated from the catalyst and withdrawn from the reaction system while the partially spent catalyst is recycled to the reactor. If desired, a portion of the catalyst can be continuously regenerated or reactivated by any suitable treatment and returned to the alkylation reactor.

In another embodiment of the invention, the amount of synthetic isopentane produced during the catalytic alkylation of olefins including propylene, butylenes and amylenes is controlled by adjusting the weight ratio of hydrogen fluoride-to-sulfolane in the alkylation catalyst. It has been found that synthetic isopentane production resulting from the catalytic alkylation of propylene, butylene and amylene olefins is influenced by the weight ratio of hydrogen fluofide-to-sulfolane in the alkylation catalyst. Particularly, the production of synthetic isopentane resulting from the alkylation of propylene, butylene and amylene olefins is suppressed or inhibited when sulfolane is added to or utilized with a hydrogen fluoride alkylation catalyst.

The recognition that the use of sulfolane with a hydrogen fluoride alkylation catalyst suppresses synthetic isopentane production from olefins when alkylated is important to the invention for controlling synthetic isopentane production during catalytic alkylation of olefins. Without this discovery, a control method would not have been invented. Once the relation between synthetic isopentane production and the alkylation catalyst hydrogen fluoride-to-sulfolane ratio are recognized, a control method can be developed.

The instant control method includes specifying a desired amount of synthetic isopentane to be produced during the catalytic alkylation of olefins. This desired amount of synthetic isopentane is somewhat limited by the physical aspects of the process but, generally, it is desirable to minimize the production of synthetic isopentane. From a practical standpoint, the desired amount of synthetic isopentane produced during the catalytic alkylation can be less than 0.6:1 weight of synthetic isopentane produced per weight olefin alkylated. Preferably, the weight ratio is less than 0.5:1 and, most preferably, it is less than 0.4:1.

The amount of synthetic isopentane produced per olefin alkylated can be controlled to a certain extent by adjusting the weight ratio of hydrogen fluoride-to-sulfolane in the alkylation catalyst; since, the amount of synthetic isopentane produced per olefin alkylated is a function of the hydrogen fluoride-to-sulfolane weight ratio in the alkylation catalyst. In order to control the synthetic isopentane produced during the alkylation of olefins, the amount produced must be measured. The measured amount of synthetic isopentane produced is compared with the desired amount with a differential being determined. In response to the differential, the weight ratio of hydrogen fluoride-to-sulfolane in the alkylation catalyst is adjusted so as to narrow the differential and to provide a synthetic isopentane production that approaches the desired isopentane production.

It has been found that synthetic isopentane suppression is most effectively achieved by controlling the weight ratio of hydrogen fluoride-to-sulfolane in the alkylation catalyst in the range of from about 1:1 to about 10:1. Preferably, the weight ratio of hydrogen fluoride-to-sulfolane will be in the range of from about 1.1:1 to about 9:1 and, most preferably, from 1.2:1 to 8.5:1.

Now referring to FIG. 1, there is presented a schematic flow diagram of an overall process system 10, which includes an FCC debutanizer, or fractionator 12, an alkylation process system 14, and a gasoline pool 16. An FCC cracked hydrocarbon stream passes to fractionator 12 by way of conduit 18. Fractionator 12 defines a separation zone and provides means for separating the FCC cracked hydrocarbon stream into a bottoms stream, containing hydrocarbons having at least 5 carbon atoms, and an overhead stream, coming hydrocarbons having less than 5 carbon atoms. The overhead stream passes by way of conduit 20 to alkylation process system 14 and serves as a feed stream to an alkylation reaction zone of alkylation process system 14. The bottoms stream passes by way of conduit 22 to gasoline pool 16 and is ultimately utilized as a gasoline blend stock for sale into the commercial marketplace.

In the inventive method, the mode of operating fractionator 12 is altered such that at least a portion of the amylenes contained in the bottoms stream is shifted to the overhead stream so as to become a part of the feed to alkylation process system 14. Thus, the compositions of the bottoms stream and the overhead stream will change with an increase in the amylene concentration of the overhead stream and an off-setting decrease in the amylene concentration of the bottoms stream.

An isoparaffin feedstock is charged to alkylation process system 14 by way of conduit 24 and serves as a reactant with the olefins of the overhead stream within the alkylation reaction zone of the alkylation process system 14. Within the alkylation reaction zone, the feedstock is contacted with an alkylation catalyst, which comprises a mixture of hydrogen fluoride and a synthetic isopentane production suppressing amount of sulfone. An alkylate product is formed by the reaction of olefins and isoparaffin, in the presence of the alkylation catalyst containing hydrogen fluoride and sulfone. By the addition of sulfone to a hydrogen fluoride alkylation catalyst, the amount of synthetic isopentane produced during the alkylation of amylene is suppressed, inhibited or minimized, thus resulting in less isopentane passing to gasoline pool 16 than would otherwise in the operation of alkylation process system 14 which uses a conventional hydrogen fluoride alkylation catalyst. The alkylate product passes from alkylation process system 14 by way of conduit 26 to gasoline pool 16. Other gasoline blending components may also pass by way of conduit 28 to gasoline pool 16 for blending with gasoline and ultimate introduction into the commercial marketplace. The final gasoline product passes from gasoline pool 16 via conduit 30.

The following example demonstrates the advantages of the present invention. The example is by way of illustration only, and is not intended as a limitation upon the invention as set out in the appended claims.

EXAMPLE I

A bench scale riser-type reactor system was used to generate the data presented in Tables I and II. The reactor consisted of a 2' section of monel schedule 40 pipe fitted with appropriate reducing unions to allow for the use of ¼" inlet and outlet monel tubing. The reactor was insulated with appropriate insulating material. The feed olefins were diluted with isobutane to get an isobutane/olefin ratio of 9–10 by weight and fed to the unit through a heat exchanger by means of a direct displacement pump calibrated with isobutane. The feed was introduced to the system acid through a solid liquid stream nozzle with a tip orifice of 0.01" diameter. The pressure drop through the nozzle was approximately 80 psig in all runs. The system allowed the reactor effluent to pass into a monel sight gauge of 704 mL capacity. In the settler, the acid settled to the bottom, where it is passed through a heat exchanger and returned to the reactor by means of a small gear pump constructed of hastelloy C and teflon gears. Feeds were held at about 15.5° C. (±2) and reactor temperatures were held at 35°–37° C. (±3) in all runs.

The hydrocarbon product was allowed to pass from the top of the settler to scrubber vessels containing ¼" alumina beads. The scrubbed product was then passed through a back-pressure regulator to a collection vessel held at 10 psig with nitrogen. The vessel allowed a simple flash to be accomplished at ambient temperature, and the system was configured so that GC samples of scrubbed settler effluent could be captured in a small (75 mL) sample bomb. Thus, no light fragments were lost. Samples of the collected liquid and flashed vapor could also be obtained.

The data presented in Table I is that for alkylation reactions with pure propylene and pure butylene feeds using a conventional hydrogen fluoride catalyst and the inventive catalyst of 70 percent hydrogen fluoride, 28 percent sulfolane and 2 percent water. The data show that the addition of sulfolane to the hydrogen fluoride catalyst suppresses the production of isopentane from both propylene and butylene.

TABLE I

Synthetic Isopentane Data for Alkylation Reactions With Pure Olefin Feeds Using Conventional HF Catalyst and Inventive Catalyst

| Catalyst<br>Feed | 98/2<br>HF/Water<br>Propylene | 70/28/2<br>HF/Sulf/<br>Water<br>Propylene | 98/2<br>HF/Water<br>Butylene | 70/28/2<br>HF/Sulf/<br>Water<br>Butylene |
|---|---|---|---|---|
| g Feed/hour | 167.9 | 167.6 | 170.2 | 170.2 |
| g Propylene conversion/hour | 12.22 | 14.00 | 0.00 | 0.00 |
| g Butylene conversion/hour | 0.00 | 0.00 | 15.28 | 14.28 |
| Product | | | | |
| g Isopentane/hour | 2.58 | 1.29 | 1.56 | 1.26 |
| Net g synthetic isopentane/hour | 2.58 | 1.29 | 1.56 | 1.26 |
| g Synthetic isopentane/hour from propylene | 2.58 | 1.29 | 0.00 | 0.00 |
| g Synthetic isopentane/hour from butylene | 0.00 | 0.00 | 1.56 | 1.26 |
| Weight synthetic isopentane/weight propylene | 0.200 | 0.092 | 0.00 | 0.00 |
| Weight synthetic isopentane/weight butylene | 0.00 | 0.00 | 0.103 | 0.088 |
| Net synthetic IC5: Reduction, % | — | 50.0 | — | 19.1 |

EXAMPLE II

The data for Table II were obtained in an exactly analogous manner as in Example I, except that a refinery feed from the Phillips Petroleum Company Borger Refinery was used rather than pure olefin feeds. Each feed was diluted with isobutane to achieve an isobutane/olefin ratio of 9–10 by weight.

For the latter two columns in Table II, the feeds consisted of Borger Refinery feed to which was added the desired amount of a C5 cut obtained by distillation of Borger Refinery FCC gasoline. This allowed the level of amylenes in the feed to be raised in a manner consistent with what the refiner would perform using the inventive method. Operation and sampling were identical to other runs as described above and in Example I.

The data presented in Table II demonstrate that the addition of sulfolane to a conventional hydrogen fluoride catalyst suppresses the production of isopentane from amylenes, butylenes and propylene. Moreover, the data show that, by removing amylenes from gasoline through shifting them into an FCC debutanizer overhead stream and alkylating the overhead stream in the presence of a hydrogen fluoride and sulfolane catalyst, synthetic isopentane production is suppressed.

TABLE II

Synthetic Isopentane Data for Alkylation Reactions With Refinery Supplied Feeds Using Conventional HF Catalyst and Inventive Catalyst

| Catalyst | 98/2 HF/Water | 70/28/2 HF/Sulf/ Water | 98/2 HF/Water | 70/28/2 HF/Sulf/ Water |
|---|---|---|---|---|
| g Feed/hour | 167.4 | 169.6 | 170.1 | 169.9 |
| g Propylene converted/hour | 2.92 | 4.91 | 3.53 | 4.27 |
| g Butylene converted/hour | 6.28 | 8.19 | 6.61 | 5.31 |
| g Amylene converted/hour | 1.95 | 1.53 | 5.07 | 4.97 |
| g Isopentane/hour in feed | 3.50 | 1.97 | 2.26 | 2.01 |
| Product | | | | |
| g Isopentane/hour Product | 6.08 | 4.07 | 6.74 | 5.29 |
| Net Isopentane, g/hour | 2.58 | 2.10 | 4.48 | 3.28 |
| g Isopentane/hr from propylene | 0.58 | 0.45 | 0.71 | 0.39 |
| g Isopentane/hr from butylene | 0.65 | 0.72 | 0.68 | 0.47 |
| g Isopentane/hr from amylene | 1.35 | 0.93 | 3.09 | 2.42 |
| Isopentane/amylene, w/w | 0.692 | 0.608 | 0.609 | 0.487 |
| Isopentane/butylene, w/w | 0.103 | 0.088 | 0.103 | 0.088 |
| Isopentane/propylene, w/w | 0.200 | 0.092 | 0.200 | 0.092 |
| Net Isopentane Reduction, % | — | 18.6 | — | 26.8 |

While this invention has been described in terms of the presently preferred embodiment, reasonable variations and modifications are possible by those skilled in the art. Such variations and modifications are within the scope of the described invention and the appended claims.

That which is claimed is:

1. A method of producing gasoline including passing a cracked hydrocarbon stream to a fractionator for providing a bottoms stream containing hydrocarbons having at least 5 carbon atoms and an overhead stream containing hydrocarbons having less than 5 carbon atoms;

passing said overhead stream to an alkylation process system for alkylating olefins with isoparaffins in the presence of a hydrogen fluoride alkylation catalyst to form an alkylate product; and passing said alkylate product and said bottoms stream to a gasoline pool;

wherein the improvement comprises:

operating said fractionator so as to reduce an amount of amylene in said bottoms stream and shift said amount of amylene into said overhead stream; and adding sulfone to said hydrogen fluoride alkylation catalyst in an amount such that synthetic isopentane production is suppressed below such production when no sulfone is added to said hydrogen fluoride alkylation catalyst, thereby reducing the amount of amylene in said gasoline pool with a minimum of production of synthetic isopentane.

2. A method as recited in claim 1 wherein the synthetic isopentane production is suppressed such that the weight ratio of synthetic isopentane produced per amylene in said overhead stream passed to said alkylation process system is less than about 0.6:1.

3. A method as recited in claim 1 wherein the concentration of amylene in said overhead stream is in the range of from about 5 mol percent to about 40 mol percent.

4. A method as recited in claim 3 wherein the synthetic isopentane production is suppressed such that the weight ratio of synthetic isopentane produced per amylene in said overhead stream passed to said alkylation process system is less than about 0.6:1.

5. A method as recited in claim 1 wherein said amount of sulfone added to said hydrogen fluoride alkylation catalyst is such as to provide a weight ratio of hydrogen fluoride to sulfone in the range of from about 1:1 to about 40:1.

6. A method as recited in claim 5 wherein the concentration of amylene in said overhead stream is in the range of from about 5 mol percent to about 40 mol percent.

7. A method as recited in claim 6 wherein the synthetic isopentane production is suppressed such that the weight ratio of synthetic isopentane produced per amylene in said overhead stream passed to said alkylation process system is less than about 0.6:1.

8. A method of producing gasoline including passing a cracked hydrocarbon stream to a fractionator for providing a bottoms stream containing hydrocarbons having at least 5 carbon atoms and an overhead stream containing hydrocarbons having less than 5 carbon atoms;

passing said overhead stream to an alkylation process system for alkylating olefins with isoparaffins in the presence of a hydrogen fluoride alkylation catalyst to form an alkylate product; and passing said alkylate product and said bottoms stream to a gasoline pool;

wherein the improvement comprises:

operating said fractionator so as to reduce an amount of amylene in said bottoms stream and shift said amount of amylene into said overhead stream; and adding a synthetic isopentane production suppressing amount of sulfone to said hydrogen fluoride alkylation catalyst, thereby reducing the amount of amylene in said gasoline pool with a minimum of production of synthetic isopentane.

9. A method as recited in claim 8 wherein the synthetic isopentane production is suppressed such that the weight ratio of synthetic isopentane produced per amylene in said overhead stream passed to said alkylation process system is less than about 0.6:1.

10. A method as recited in claim 8 wherein the concentration of amylene in said overhead stream is in the range of from about 5 mol percent to about 40 mol percent.

11. A method as recited in claim 10 wherein the synthetic isopentane production is suppressed such that the weight ratio of synthetic isopentane produced per amylene in said overhead stream passed to said alkylation process system is less than about 0.6:1.

12. A method as recited in claim 8 wherein said amount of sulfone added to said hydrogen fluoride alkylation catalyst is such as to provide a weight ratio of hydrogen fluoride to sulfone in the range of from about 1:1 to about 40:1.

13. A method as recited in claim 12 wherein the concentration of amylene in said overhead stream is in the range of from about 5 mol percent to about 40 mol percent.

14. A method as recited in claim 13 wherein the synthetic isopentane production is suppressed such that the weight ratio of synthetic isopentane produced per amylene in said overhead stream passed to said alkylation process system is less than about 0.6:1.

15. A method for controlling the amount of synthetic isopentane produced during a catalytic alkylation of olefins selected from the group consisting of propylene, 2-butene, amylenes and mixtures of two or more thereof by utilizing an alkylation catalyst containing hydrogen fluoride and sulfolane in an alkylation process to produce an alkylate product containing a desired amount of synthetic isopentane produced by said catalytic alkylation of olefins, said method comprises the steps of:

specifying said desired amount of synthetic isopentane produced by said catalytic alkylation of olefins;

measuring the amount of synthetic isopentane produced by said catalytic alkylation of olefins to define a measured amount;

determining a difference between said desired amount of synthetic isopentane production and said measured amount of synthetic isopentane production; and adjusting the weight ratio of hydrogen fluoride to sulfolane in said alkylation catalyst in response to said difference so as to narrow said difference and to provide a synthetic isopentane production that approaches said desired synthetic isopentane production.

16. A method as recited in claim 15 wherein the weight ratio of hydrogen fluoride to sulfolane in said alkylation catalyst is in the range of from about 1.2:1 to about 8.5:1.

17. A method as recited in claim 15 wherein said desired amount of synthetic isopentane produced by said catalytic alkylation of olefins is such that the weight ratio of synthetic isopentane produced per olefin alkylated is less than 0.6:1.

18. A method as recited in claim 15 wherein said measured amount of synthetic isopentane produced per olefin alkylated exceeds 0.6:1.

19. A method as recited in claim 16 wherein said desired amount of synthetic isopentane produced by said catalytic alkylation of olefins is such that the weight ratio of synthetic isopentane produced per olefin alkylated is less than 0.6:1 and wherein said measured amount of synthetic isopentane produced per olefin alkylated exceeds 0.6:1.

* * * * *